US005127331A

United States Patent [19]

Stoops

[11] Patent Number: 5,127,331

[45] Date of Patent: Jul. 7, 1992

[54] REDUCED RECOIL COMPRESSION FORMED SHOTSHELL CASING

[75] Inventor: Billy J. Stoops, Shipman, Ill.

[73] Assignee: Olin Corporation, Cheshire, Conn.

[21] Appl. No.: 674,012

[22] Filed: Mar. 25, 1991

[51] Int. Cl.[5] ..... F42B 5/30

[52] U.S. Cl. ..... 102/467; 102/470

[58] Field of Search ..... 102/466, 467, 469, 470, 102/472, 448

[56] References Cited

U.S. PATENT DOCUMENTS

| | | | |
|---|---|---|---|
| 3,176,614 | 4/1965 | Woodring | 102/43 |
| 3,185,095 | 5/1965 | Mayer et al. | 102/44 |
| 3,292,541 | 12/1966 | Stadler | 102/467 |
| 3,351,014 | 11/1967 | Metcalf et al. | 102/43 |
| 3,359,903 | 12/1967 | Sobolewski | 102/466 |
| 3,611,938 | 10/1971 | King et al. | 102/467 |
| 4,007,686 | 2/1977 | Hugonet | 102/44 |
| 4,970,959 | 11/1990 | Bilsbury et al. | 102/450 |

FOREIGN PATENT DOCUMENTS

| | | | |
|---|---|---|---|
| 919583 | 3/1947 | France | 102/466 |

*Primary Examiner*—Harold J. Tudor

*Attorney, Agent, or Firm*—John R. Wahl

[57] ABSTRACT

A shotshell casing has a tubular body with an open mouth end and an integral compression formed basewad portion at the other end. A metal case head is preferably installed over the basewad portion. The basewad portion has a circumferential channel in the wall of the body above the end of the basewad portion. This channel forms a cavity beneath the metal case head which collapses upon propellant ignition to absorb a portion of the recoil force produced upon shotshell firing.

12 Claims, 1 Drawing Sheet

REDUCED RECOIL COMPRESSION FORMED SHOTSHELL CASING

BACKGROUND OF THE INVENTION

The present invention generally relates to shotshell casings and more particularly to a compression formed shotshell having an integral collapsible basewad at the head end of the shotshell.

Compression formed shotshells have been well known for over 25 years. Such shotshells are exemplified by the shotshells and forming methods disclosed in U.S. Pat. Nos. 3,164,090, 3,176,614, and 3,351,014 issued to Metcalf et al. In the conventional compression forming process, a blank of high density polyethylene is formed preferably by injection molding. This blank is then compressed in a die such that the sides of the blank are extruded to form the elongated case wall portion and the remainder of the blank is formed into the basewad portion. A metal head is generally installed over the base portion either before or after compression forming and the open end of the compression formed shell casing trimmed to the proper length. This method of case formation generates an inexpensive, one piece shotshell casing that is waterproof and has the required sidewall strength to withstand the extreme pressures developed during propellant ignition. Shotgun shooters who infrequently practice their sport generally learn to tolerate the strong recoil that accompanies each shotshell firing. However, this recoil is still a significant concern especially to competitors and to those who fire a significant number of shotshells during trap and skeet practice. Butt pads and padded shoulders on shooting jackets have been developed to help absorb this recoil. There is always a need to reduce the recoil felt by the shooter, especially for those who shoot extensively.

One approach to reducing recoil is a shotshell which has a collapsible basewad as is described in U.S. Pat. No. 4,970,959, assigned to the assignee of the present invention. The collapsible basewad is formed with an external circumferential channel which, when inserted into the tubular shell casing, forms an annular cavity inside the case which collapses upon propellant ignition to reduce pressure and absorb some of the force which produces recoil. This collapsible basewad is preferably used with Reifenhauser tubing. However, this basewad cannot be used in a compressioned formed shotshell. Hence there is a need for a compression formed shotshell which produces reduced recoil for a given load.

SUMMARY OF THE INVENTION

The compression formed shotshell in accordance with the present invention addresses this need directly in an inexpensive way. The shotshell of the invention is compression formed in a conventional manner. However, it has an annular cavity defined by the basewad portion and preferably the metal head which collapses upon propellant ignition. This collapse reduces the recoil experienced by the shooter by absorbing some of the recoil energy.

The injection molded preform is a generally cylindrical body with an outer wall symmetrical about a central axis, a concave open upper end portion, a lower end portion terminating in a flat end preferably having a circumferential flange, and a recess formed in the outer wall. The lower portion of the preform body forms the basewad portion of the compression formed shotshell casing and has a central through bore which communicates with the concave open upper end. The concave upper end is preferably conical in shape and joins with the through bore at its apex. The upper portion forms the tubular portion of the compression formed shotshell.

The compression formed shotshell is typically placed in a cup shaped metal head. The recess in the outer wall and the inner surface of the metal head define a collapsible cavity outside of the powder chamber and within the shotshell casing. Alternatively, if a metal head is not used, the recess in the outer wall of the basewad portion of the shotshell and the shotgun chamber into which the shotshell is placed define the collapsible cavity.

The recess preferably takes the form of a circumferential channel formed in its outer wall above the flange. This channel may be flat bottomed or may have a "U" shape cross section. The channel is located just above the flange and is about 0.3 inches deep radially and at least 0.1 inch wide axially. The channel may also be spaced axially from the flange.

This preform is compression formed in a conventional manner into a final shotshell casing form. The preform may be inserted into a cup shaped metal head prior to compression forming or alternately headed after forming as described in the typical patents referred to above. During compression forming, the channel is compressed and deformed into an oval annular channel.

After compression forming, the open upper end portion is trimmed to the proper length and the casing primed and loaded. The compression forming process deforms but does not completely collapse the channel in the outer wall of the lower end portion of the casing. Thus an annular cavity is formed beneath the metal head above the case rim. This cavity collapses upon firing the shotshell thus absorbing part of the shock of recoil and thus reducing the recoil felt by the shooter.

DETAILED DESCRIPTION OF THE PREFERRED EMBODIMENTS

Figure 1:
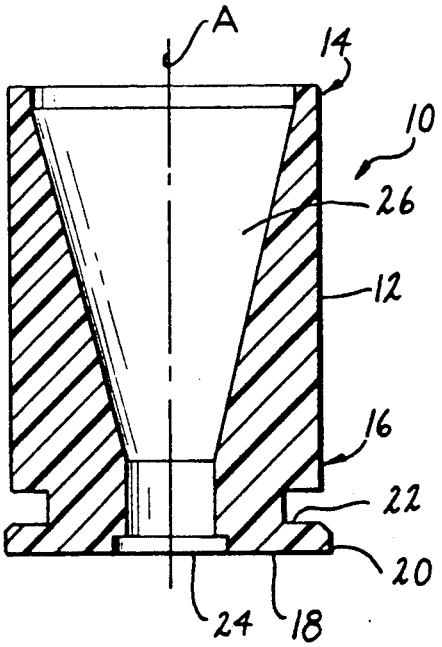
FIG. 1 is a sectional view of a first embodiment of the preform used to form a shotshell in accordance with the present invention.
Figure 3:
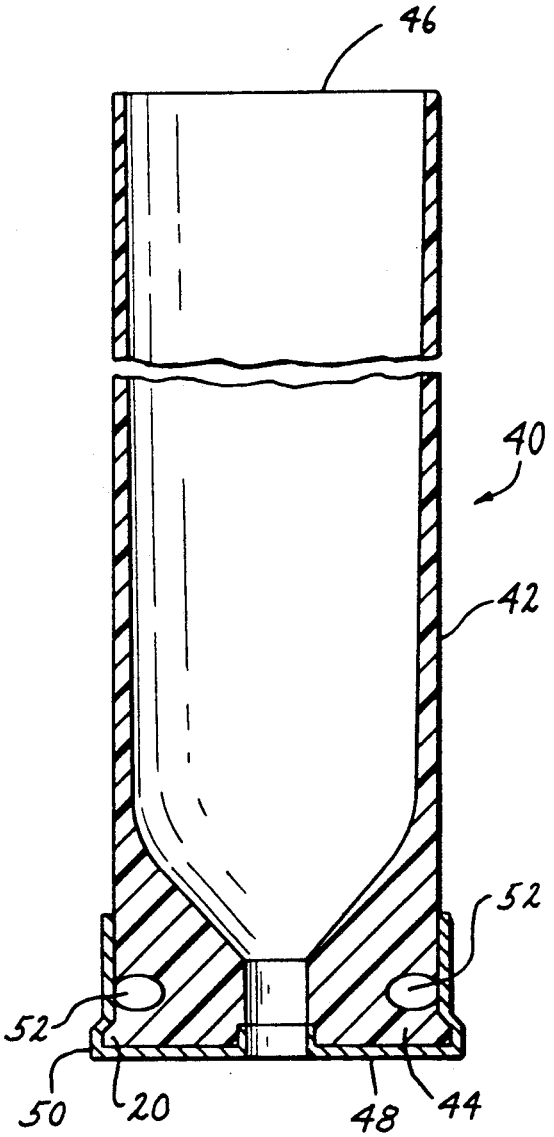
FIG. 3 is a sectional view of a compression formed shotshell case in accordance with the present invention formed from the preform in FIG. 2.

A first embodiment of the preform used to compression form the shotshell in accordance with the present invention is shown in FIG. 1. The injection molded preform 10 is a generally cylindrical crystalline solid plastic body preferably of high density polyethylene with an outer wall 12 symmetrical about a central axis "A", a concave open upper end portion 14, and a lower end portion 16 terminating in a generally flat transverse end surface 18. The lower end portion 16 has a circumferential flange 20 around the perimeter of the end surface 18 and a recess in the outer wall 12. This recess is preferably a circumferential channel 22 and may be axially positioned adjacent the flange 20. The lower portion 16 has a central through bore 24 which communicates with the concave open upper end 14. The concave upper end 14 preferably forms a conical cavity 26 which joins with the through bore 24 at its apex. The upper portion is compressioned formed into the shotshell case side wall and the lower portion 16 of the preform body forms an integral basewad in the shotshell casing 40 as shown in FIG. 3.

Figure 2:
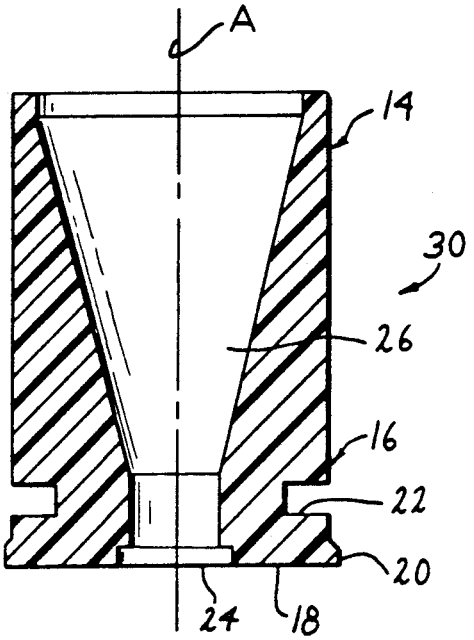
FIG. 2 is a sectional view of a second embodiment of the preform used to form a shotshell in accordance with the present invention.

A second embodiment of the preform used to compression form the shotshell in accordance with the present invention is shown in FIG. 2. Preform 30 is identical to the first embodiment except for the placement of the channel. Accordingly, like numbers are used to describe like features of the preform.

Preform 30 is a generally cylindrical plastic body with an outer wall 12 symmetrical about a central axis "A", a concave open upper end portion 14, a lower end portion 16 terminating in a generally flat transverse end surface 18. The lower end portion 16 has a circumferential flange 20 around the perimeter of the end surface 18 and a circumferential channel 22 through the outer wall 12 spaced from the flange 20. The lower portion 16 has a central through bore 24 for eventually receiving ans supporting a primer. The bore 24 communicates with the concave open upper end 14. The concave upper end 14 forms a cavity 26 preferably conical in shape and joins with the through bore 24 at its apex. The lower portion 16 of the preform body forms an integral basewad in the shotshell casing 40 as shown in FIG. 3.

The channel 22 may be flat bottomed or may have a "U" shape cross section. The channel is preferably located adjacent to the flange. Alternatively, the channel 22 may also be spaced from the flange as is shown in FIG. 2.

A channel depth of at least 0.2 inches should reduce the recoil force perceptibly. The optimum size of the channel is dictated by several considerations such as maintaining sufficient basewad material for required primer support to preclude gas leaks during ignition and provide sufficiently rigid primer support to prevent flexing of the head and the primer during the firing pin blow. The channel 22 in a preform for a 12 gauge shotshell is believed to be optimal at preferably about 0.3 inches deep and at least 0.1 inch wide.

This preform 10 is injection molded in a suitable mold cavity in a conventional manner. The preform is then compression formed in a conventional manner into the final shotshell casing 40 as is shown in FIG. 3.

Shotshell casing 40 comprises a compression formed body 42 having an integral basewad end portion 44 and an open tubular upper end 46. Flange 20 on preform 10, 30 is carried over and remains on the basewad end 44. After compression forming, the open upper end 46 is trimmed to the proper length and a metal head 48 installed onto the basewad end 44. The metal head 48 is crimped onto the basewad end 44 so as to mechanically interlock with the flange 20 forming a rim 50. Alternatively, the preform 10 or 30 may be inserted into a metal head 48 and then compression formed thus eliminating the separate heading step. Finally, the casing is primed and loaded.

The compression forming process deforms but does not completely collapse the channel 22 in the outer wall of the lower end portion 16 of the preform which becomes the basewad 44 of the casing 40. the compression forming process is performed at a preform temperature above 200° F. and pressures in the range of 30,000 to 40,000 psi. Movement of the plastic at these high pressures is focused primarily around the tapered tip of the die punch being inserted into the preform to form the tubular upper portion 46 of the shotshell. The channel 22, however, is not collapsed as it is spaced from the moving punch in the die chamber. At these pressures, the channel 22 is deformed into an oval cross sectional shape.

The head 48 closes the channel 22 which creates an annular cavity 50 beneath the metal head. In contrast to the forming pressures, the pressure developed during propellant ignition are believed to resiliently collapse the cavity 50. This collapse absorbs force and dissipates some of the recoil energy thus absorbing part of the shock and thus reducing the recoil felt by the shooter.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A shotshell casing comprising:

a unitary one-piece, compression formed plastic body having a tubular upper portion and a generally cylindrical basewad portion, said basewad portion having an outer wall coextensive with said tubular upper portion, a generally flat flanged end and a central through bore communicating with said upper portion for receiving a primer, said wall having a continuous circumferential outwardly open resiliently collapsible empty channel therein around and spaced radially from said bore below said upper portion above said flanged end and a metal head over said flanged end, said head having a tubular portion of constant internal diameter extending over and closing said channel.

2. The shotshell casing according to claim 1 wherein said channel has a radial depth of at least 0.200 inches.

3. The shotshell casing according to claim 2 wherein said channel has an axial width of at least 0.1 inches.

4. The shotshell casing according to claim 3 wherein said channel is about 0.3 inches deep radially.

5. The shotshell casing according to claim 1 wherein said channel is adjacent said flanged end.

6. The shotshell casing according to claim 1 wherein said channel is axially spaced from said flanged end.

7. The shotshell casing according to claim 6 wherein said channel has a radial depth of at least 0.2 inches.

8. The shotshell casing according to claim 7 wherein said channel has an axial width of at least 0.1 inches.

9. The shotshell casing according to claim 7 wherein said channel is about 0.3 inches deep radially.

10. The shotshell casing according to claim 5 wherein said channel has a radial depth of at least 0.2 inches.

11. The shotshell casing according to claim 10 wherein said channel has an axial width of at least 0.1 inches.

12. The shotshell casing according to claim 11 wherein said channel is about 0.3 inches deep radially.

* * * * *